United States Patent [19]

Swiatosz

[11] Patent Number: 4,471,774

[45] Date of Patent: Sep. 18, 1984

[54] OXYGEN BREATHING APPARATUS SIMULATOR USING SUPPLEMENTAL OXYGEN

[75] Inventor: Edmund Swiatosz, Maitland, Fla.

[73] Assignee: The United States of America as represented by the Secretary of the Navy, Washington, D.C.

[21] Appl. No.: 391,191

[22] Filed: Jun. 23, 1982

[51] Int. Cl.[3] ..... A62B 7/00

[52] U.S. Cl. ..... 128/205.12; 128/200.24; 128/205.17; 434/262

[58] Field of Search ..... 128/205.12, 205.29, 128/206.15, 201.25, 202.26, 205.13, 205.23, 201.11, 205.24, 205.28, 204.28, 205.17; 434/262

[56] References Cited

U.S. PATENT DOCUMENTS

| | | | |
|---|---|---|---|
| 4,019,507 | 4/1977 | Oetjen et al. | 128/202.26 |
| 4,066,076 | 1/1978 | Williamson | 128/205.12 |
| 4,265,238 | 5/1981 | Swiatosz et al. | 128/205.12 |

FOREIGN PATENT DOCUMENTS

| | | | |
|---|---|---|---|
| 493160 | 3/1930 | Fed. Rep. of Germany | 128/205.12 |
| 562162 | 10/1932 | Fed. Rep. of Germany | 128/205.12 |
| 513703 | 8/1976 | U.S.S.R. | 128/205.12 |

*Primary Examiner*—Henry J. Recla
*Assistant Examiner*—Karin M. Reichle
*Attorney, Agent, or Firm*—Robert F. Beers; Robert W. Adams; Robert J. Veal

[57] ABSTRACT

A training canister for use with a personal breathing apparatus supplements filtered air with oxygen supplied by an internal cylinder. The canister has an integral filter providing airflow to the breathing apparatus, and utilizes a miniature high pressure valve to release supplemental oxygen into the system from an oxygen cylinder charged to up to 2000 psi. The training canister simulates operational equipment in size, shape, integration to the personal breathing apparatus, and actuation.

5 Claims, 2 Drawing Figures

OXYGEN BREATHING APPARATUS SIMULATOR USING SUPPLEMENTAL OXYGEN

FIELD OF THE INVENTION

The present invention relates to fire fighting trainers and in particular to the personal breathing apparatus used in such training. More particularly, the present invention relates to the canisters used to supply air to the breathing apparatus during such training.

DESCRIPTION OF THE PRIOR ART

Familiarity with and confidence in one's equipment is nowehre more necessary than in life threatening situations where the equipment may be the difference between life and death. As evidence of this, the armed services have and are continuing to use operational equipment for emergency response training.

One such item of operational equipment being utilized in training firefighting teams is the oxygen breathing apparatus, or OBA, manufactured by the Mine Safety Appliance Company. The OBA uses an oxygen generating canister, which is in and of itself pyrotechnically dangerous, as well as being quite expensive, each nonreusable canister costing over $27.

In order to alleviate the expense and the hazard of the operational canister, U.S. Pat. No. 4,265,238 issued to Edmund Swiatosz et al on May 5, 1981, modified a standard OBA to circulate air which had been filtered by a simulated canister. The simulated canister was reusable and nonhazardous in and of itself; however, the design cannot be considered completely successful or safe, inasmuch as consumption of the available oxygen by trainer fires may reduce the usable level of oxygen below an acceptable standard for training purposes.

SUMMARY OF THE INVENTION

The present invention utilizes a hybrid approach to overcome the disadvantages of the pyrotechnic oxygen canister and the simulated canister with filter. The filtration system of the prior art is retained and supplemented by the use of a small rechargeable cylinder which slowly releases sufficient oxygen into the modified OBA system to maintain a safe usable oxygen level. A single activating lever opens a passage from the filter to the OBA system and opens a bleed valve on the rechargeable cylinder.

It is an object of the present invention to provide a safe and reusable personal breathing device useful in training personnel in firefighting.

It is another object to provide a training device with the above features at a reasonable cost.

The features of the invention desired to be protected are set forth in the appended claims. The invention itself, together with further objects and advantages thereof may best be understood by referring to the following description taken in conjunction with the appended drawings.

DESCRIPTION OF A PREFERRED EMBODIMENT

An operational OBA is a self-contained breathing apparatus utilizing a canister of chemical reagents which produce oxygen upon activation. After an initial start-up aided by a candle, air from the user is recirculated through the canister, thereby achieving a selfsustaining reaction to produce oxygen until the chemical reagants are exhausted.

U.S. Pat. No. 4,265,238 incorporated by reference, shows a modification of an OBA which eliminates the chemical reagents within the canister by utilizing filtered enviromental air to inflate the OBA breathing bags and to supply air to the trainee. Unfortunately, the environmental air in a realistic trainer may have 15% or less usable oxygen in it due to oxygen consumption by the trainer fires. An oxygen level of 19% is considered to be necessary to insure the safety of the trainees.

Figure 1:
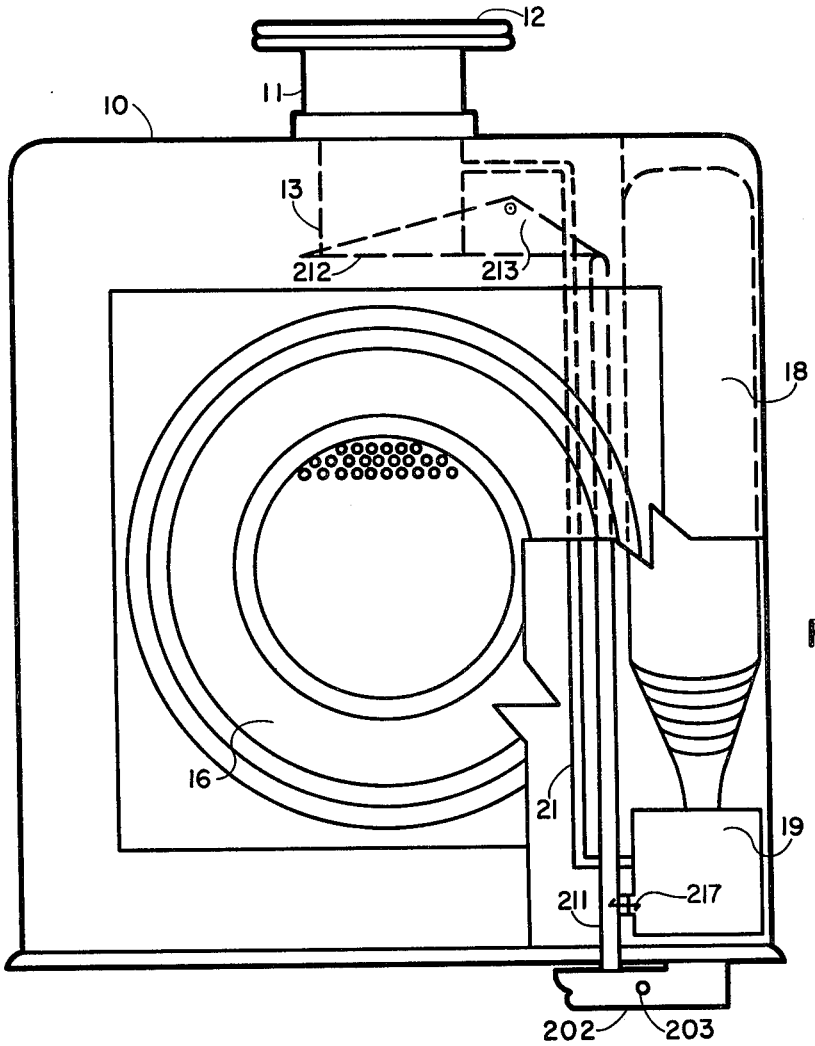
FIG. 1 is a frontal cutaway view of the simulated OBA canister.
Figure 2:
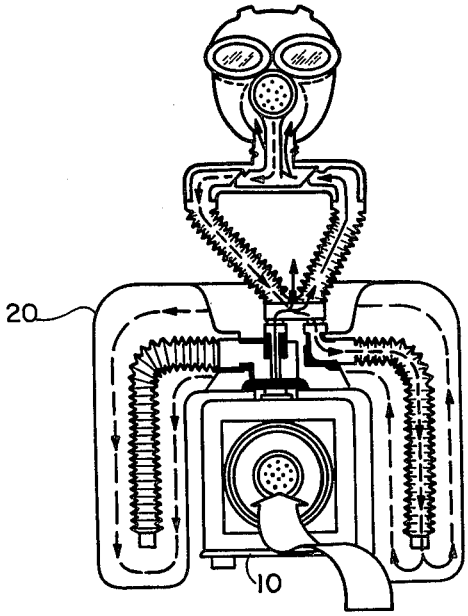
FIG. 2 is a depiction of the simulated canister in a modified OBA.

Referring to FIG. 1, the present invention utilizes a simulated OBA canister 10 which is identical to the operational canister in terms of its size, shape and weight. Canister 10 has neck 11 through which there is provided an output port 12. Neck 11 and port 12 integrate into the modified OBA 20 of U.S. Pat. No. 4,265,238 in the same manner as the conventional canister, as shown in FIG. 2.

Port 12 is connected to a filter 16 via a conduit means 13. Housed within canister 10 is a storage bottle 18 containing a supply of oxygen to supplement the air received via filter 16 and conduit means 13. The oxygen from bottle 18 is released through valve 19 into a second conduit means 21 connected to port 12.

Bottle 18 is a reusable container capable of withstanding and holding a charge of compressed oxygen up to 2000 psi. The higher pressure is necessitated by the limited space available, inasmuch as bottle 18 fits within canister 10. Bottle 18 may be up to approximately two inches in diameter and five inches in length. A bottle of this size will provide supplemental oxygen for about 20 minutes when charged to 2000 psi.

Again, due to space limitations, valve 19 must be a miniature high pressure valve capable of handling a 2000 psi load under repeated opening and closure states in the training environment. Depending on the model valve selected for use as valve 19, said valve 19 may be located as shown in FIG. 1 or may be connected to bottle 18 by a suitable length of tubing.

By way of illustration, the $\frac{1}{8}$ C.P.I. model 2Z-B26J2-B miniature 90° ball valve distributed by Dixie Valve of Jacksonville, Ala., meets the size requirements and is capable of withstanding the 2000 psi pressures.

Conduit 21 is a small diameter tubing designed to permit an airflow of $\frac{1}{3}$ cfm from valve 19 to port 12. Alternatively, a needle valve (not shown) may be used to regulate the flow; however, access thereto would be restricted.

Actuation of the canister is to simulate the operational equipment, thus spring loaded lever 202 and cotter pin 203 are identical to the operational counterparts. In the operational canister, oxygen generation is initiated by the user pulling a lanyard to remove a cotter pin which is holding a spring-loaded lever in a fixed position. The lever is pivotally mounted to the bottom of the operational canister such that the removal of the cotter pin allows the spring to rotate the lever which in turn drives a firing pin upwards into a chlorate candle. For the most effective training, the activation of the training canister should be identical in terms of the action required by the trainee; thus the identity between spring loaded lever 202, cotter pin 203, and their operational counterparts. Port closure 212 is opened via levers 213 and 211 when lever 202 is displaced by the trainee by withdrawing cotter pin 203. When cotter pin 203 is withdrawn, spring loaded lever 202 forces lever 211 upwards to rotate lever 213 such that port closure 212 rotates away from port 13 to permit fresh air to flow upwards from filter 16. Port closure 212 is physically integrated to lever 213 and may be any type cap or plate which would substantially block the passage of air through port 13. This mechanization is the same as used in U.S. Pat. No. 4,265,238. Lever 211 is also connected to activate valve 19. The connection 213 between valve 19 and lever 211 is such that the upward motion of lever 211 due to the action of lever 202 is mechanically coupled to valve 19 such that said valve 19 is opened thereby.

Obviously, many modifications and variations of the present invention are possible in the light of the above teachings. It is therefore to be understood that within the scope of the appended claims, the invention may be practiced otherwise than as specifically described.

What is claimed is:

1. A training canister for use with a personal breathing apparatus of the type wherein an expendable canister provides oxygen due to a chemical reaction, said training canister replacing said expendable canister and comprising:

a reusable housing having an aperture for the intake of environmental air and a port for the discharge of air, said housing forming a conduit for air flow between said aperture and said port, said housing having the configuration of said expendable canister, including a body portion, a base supporting said body portion and a neck opposite said base, said neck circumscribing said port;

filtration means operably attached to said housing to filter environmental air entering said housing through said aperture;

means for storing oxygen under pressure within said housing, having an outlet for the release of oxygen into said conduit;

means for controlling the rate of release of said oxygen operably connected between said storing means outlet and said conduit;

closure means pivotally mounted within said housing for controlling air flow through said port;

an actuating lever pivotally mounted to said housing base;

a pin removably connected to both said actuating lever and said housing base to prevent movement of said actuating lever until removal of said pin;

connecting means passing through the housing base, abutting said actuating lever and said closure means to maintain said closure means in a closed position until removal of said pin said controlling means being responsive to movement of said connecting means whereby, upon removal of said pin, said actuating lever rotates, said connecting means translates and thereby actuates said controlling means and said closure means rotates to permit flow through said conduit.

2. The canister of claim 1, wherein said storage means is a reusable cylinder.

3. The canister of claim 2, wherein said cylinder is adapted to withstand internal pressures up to 2000 psi.

4. The canister of claim 1, wherein said controlling means comprises a miniature high pressure valve connected to the outlet of said storage means and having an outlet to said conduit.

5. The canister of claim 4, wherein said controlling means further comprises a small diameter tubing for allowing a predetermined airflow connected between the outlet of said valve and said conduit.

* * * * *